US008727799B2

(12) United States Patent
Osawa et al.

(10) Patent No.: US 8,727,799 B2
(45) Date of Patent: May 20, 2014

(54) SEAL MEMBER AND A CHARGING CONNECTOR PROVIDED THEREWITH

(75) Inventors: Kiyoshi Osawa, Yokkaichi (JP); Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 6 days.

(21) Appl. No.: 13/609,334

(22) Filed: Sep. 11, 2012

(65) Prior Publication Data

US 2013/0105219 A1 May 2, 2013

(30) Foreign Application Priority Data

Oct. 28, 2011 (JP) ..... 2011-237248

(51) Int. Cl.
*H01R 13/52* (2006.01)

(52) U.S. Cl.
USPC ..... 439/275

(58) Field of Classification Search
USPC ..... 439/275, 274; 277/630, 637
See application file for complete search history.

(56) References Cited

U.S. PATENT DOCUMENTS

| | | | | |
|---|---|---|---|---|
| 5,720,487 | A * | 2/1998 | Kato | 277/637 |
| 6,341,983 | B1 * | 1/2002 | Crawford et al. | 439/587 |
| 6,602,090 | B2 | 8/2003 | Kato | |
| 6,609,932 | B2 * | 8/2003 | Fukatsu et al. | 439/588 |
| 7,033,216 | B2 * | 4/2006 | Ito | 439/587 |
| 7,044,762 | B1 * | 5/2006 | Hong et al. | 439/275 |
| 7,104,841 | B2 * | 9/2006 | Fukatsu et al. | 439/587 |
| 2001/0049226 | A1 | 12/2001 | Murakami et al. | |
| 2007/0117441 | A1 * | 5/2007 | Tanaka | 439/275 |
| 2009/0215298 | A1 * | 8/2009 | Chazottes et al. | 439/275 |

FOREIGN PATENT DOCUMENTS

| | | |
|---|---|---|
| DE | 10054714 | 5/2002 |

* cited by examiner

*Primary Examiner* — Gary Paumen
(74) *Attorney, Agent, or Firm* — Gerald E. Hespos; Michael J. Porco; Matthew T. Hespos

(57) ABSTRACT

A seal member (50) is to be mounted on an end of a multi-core cable (40), in which a plurality of wires (41) are bundled together and covered with an outer sheath (42). The seal member (50) is to be accommodated into a rear housing (21) of a charging connector (10) and includes a rubber plug (51) and a restricting member (52) to be externally fit on the rubber plug (51). The rubber plug (51) is formed with a cable seal portion (53) that resiliently comes into close contact with the outer peripheral surface of the outer sheath (42), and the cable seal portion (53) includes a wire seal portion (54) that individually and resiliently comes into close contact with the outer peripheral surfaces of the wires.

12 Claims, 6 Drawing Sheets

SEAL MEMBER AND A CHARGING CONNECTOR PROVIDED THEREWITH

BACKGROUND OF THE INVENTION

1. Field of the Invention

The invention relates to a seal member and to a charging connector provided therewith.

2. Description of the Related Art

U.S. Pat. No. 6,602,090 discloses a charging connector connected to ends of wires, such as signal wires and power wires. The wires are pulled into a housing of the charging connector and each wire is connected to a predetermined connecting portion in the housing.

A multi-core cable is formed by bundling wires together and covering the bundled wires with an outer sheath. An end of this multi-core cable then can be pulled into a housing. Water, such as rainwater, may enter the housing and flow into the inside of the outer sheath of the multi-core cable through clearances between the respective wires and may penetrate to a power supply part through the inside of the outer sheath.

Thought has been given to placing a sealant between the wires at the end of the outer sheath to close the clearances and then mounting a heat shrinkable tube or the like on the outer side of the end of the outer sheath to make the end of the outer sheath waterproof. However, the sealant must bond the wires over a significant distance along the longitudinal direction of the wires to reliably close the clearances between the wires reliably. Further, the sealant is expensive and reliably filling the clearances between the respective wires with the sealant is difficult. Therefore sealing is not stable.

The invention was completed in view of the above situation and an object thereof is to waterproof an end of an outer sheath of a cable reliably, inexpensively and without enlarging a waterproof structure.

SUMMARY OF THE INVENTION

The invention relates to a seal member to be mounted on an end of a cable, in which one or more wires are covered with an outer sheath, and to be accommodated into a housing of a charging connector. The seal member includes a resilient plug made of a resilient material and a restricting member mounted externally on the resilient plug for restricting expansion of the resilient plug. The resilient plug has a cable seal portion that resiliently comes into close contact with the outer peripheral surface of the outer sheath over the entire circumference. The cable seal portion includes a wire seal portion that individually and resiliently comes into close contact with the outer peripheral surfaces of the wires over the entire circumference.

The end of the outer sheath is inserted into the cable seal portion so that the cable seal portion is brought resiliently into close contact with the outer sheath to provide sealing between the cable seal portion and the outer sheath. Similarly, the wire seal portion is brought resiliently into close contact with the wires to provide sealing adjacent the wires. Thus, the end of the outer sheath of the cable is waterproofed by an inexpensive member as compared with a heat shrinkable tube, a sealant and the like.

Further, the efficiency of a fluid- or waterproof operation can be improved as compared with the case where a heating treatment is applied after a sealant is filled adjacent to the respective wires at the end of the outer sheath and a heat shrinkable tube or the like is mounted on the end of the outer sheath.

Furthermore, a close contact part of the seal member with the outer sheath and the wires is smaller than the case where a sealant is filled adjacent the respective wires and the outer side is sealed by a heat shrinkable tube.

The wire seal portion preferably is integral or unitary with a front end part of the cable seal portion where one or more wires are pulled out.

The cable seal portion may be substantially in the shape of a cylinder that covers the end of the outer sheath over the entire circumference.

The wire seal portion may be at an angle and preferably substantially perpendicular to an extending direction of the one or more wires and formed to close a front end opening of the cable seal portion.

The restricting member may be formed in the shape of a cylinder that covers the entire outer peripheral surface of the cable seal portion. Thus, a mounting operation is easy since the restricting member can be mounted on the outer peripheral surface of the cable seal portion merely by inserting the cylindrical cable seal portion into the cylindrical restricting member.

The wire seal portion may have a plurality of wire insertion holes into which the wires of a multi-core cable are inserted individually.

Some wires may have a slightly smaller outer diameter than the other wires and some of the wire insertion holes of the wire seal portion may be slightly smaller in conformity with the outer diameter of some of the wires. Sealing is impaired if the smaller wire is inserted into a larger wire insertion hole. Thus, the smaller wire insertion holes must be confirmed at the time of the mounting operation. Accordingly, at least one mark is attached to the cable seal portion and the wire seal portion to indicate the wire insertion hole having a different hole diameter. Thus, the wires can be inserted into the wire insertion holes by confirming the mark, thereby improving operational efficiency and avoiding erroneous insertion of the other wires into the wire insertion holes.

One or more outer sheath side lips may be provided on an inner peripheral surface of the cable seal portion for close resilient contact with the outer peripheral surface of the outer sheath. The outer sheath side lips may be arranged on a rear part of the cable seal portion and closely contact the outer peripheral surface of the outer sheath when the outer sheath of the cable is fit into the cable seal portion.

One or more cap side lips may be provided on an outer peripheral surface of the cable seal portion. The wire seal portion may be arranged at the inner side of the cap side lips on or near the front part of the cable seal portion.

The invention also relates to a charging connector with a housing and the above-described seal member accommodated in the housing.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
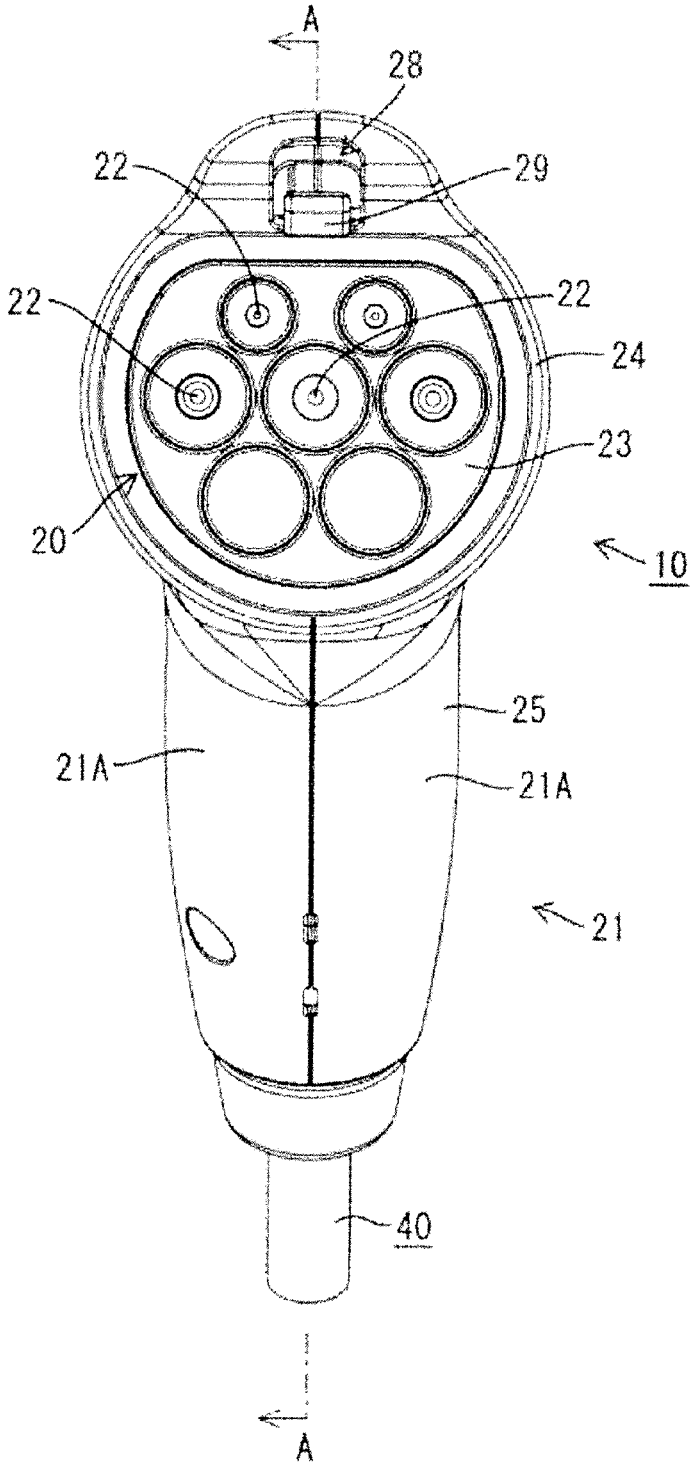
FIG. 1 is a front view of a charging connector.
Figure 2:
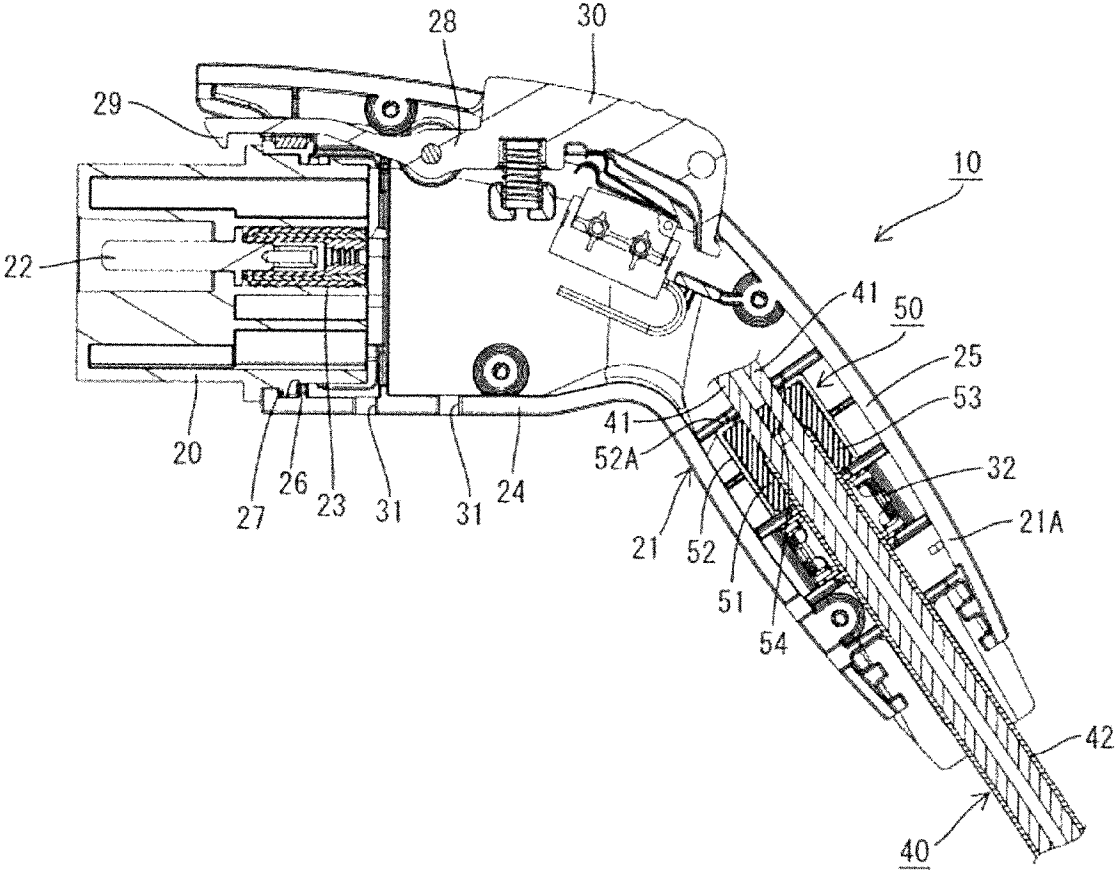
FIG. 2 is a section along A-A of FIG. 1.

A charging connector in accordance with the invention is identified by the numeral 10 in FIGS. 1 and 2. The charging connector 10 is connected to an end of a multi-core cable 40 extending from an external power supply side and is connectable to an unillustrated vehicle side connector mounted in a vehicle.

The charging connector 10 includes a front housing 20 and a rear housing 21 both of which are made e.g. of synthetic resin. The front housing 20 can fit into an unillustrated vehicle side receptacle in the vehicle side connector, and the rear housing 21 is assembled with a rear part of the front housing 20.

The front housing 20 is substantially cylindrical and includes a terminal holding portion 23 in which male terminals 22 are held. The male terminals 22 are to be connected electrically conductively to unillustrated female terminals in the vehicle side receptacle when the front housing 20 is fit properly into the vehicle side receptacle.

The rear housing 21 comprises two unitarily formed half members 21A that are separated longitudinally. The half members 21A are combined with one another and fixed by screws. The rear housing 21 includes a main body 24 that extends back from the rear part of the front housing 20 and a grip 25 that extends obliquely down from a rear end part of the main body 24.

A mounting groove 26 is formed around the inner periphery of a front part of the main body 24. On the other hand, a flange 27 is formed around the outer periphery of the rear part of the front housing 20 and can fit into the mounting groove 26 of the main body 24. The rear part of the front housing 20 is sandwiched from left and right sides by the main body 24 and the flange 27 is fit into the mounting groove 26 of the main body 24 to assemble the front and rear housing 20 and 21, as shown in FIG. 2.

A connection lever 28 is mounted on upper side of the interior of the main body 24 to extend forward and back. An intermediate part of the connection lever 28 is mounted pivotably in the housing main body 24. A front part of the connection lever 28 is arranged outside the front housing 20 and a rear part of the connection lever 28 projects out from the upper surface of the rear part of the main body 24.

A lock 29 projects from the lower surface of the front end part of the connection lever 28. The lock 29 engages the vehicle side receptacle when the vehicle side receptacle and the front housing 20 are connected properly to hold the vehicle side receptacle and the front housing 20 in a connected state.

An unlocking portion 30 is defined at the rear of the connection lever 28 and projects out from the main body 24. The front part of the connection lever 28 is lifted out in a disengaging direction when the unlocking portion 30 is pressed in toward the main body 24. Thus, the front housing 20 can be separated from the vehicle side receptacle.

Fluid or water drainage holes 31 are formed in the lower side of the housing main body 24 so that any fluid or water that enters through clearances between the half members 21A of the rear housing 21 can escape to the outside when the charging connector 10 is exposed to rain or the like.

The grip 25 is narrower than the main body 24 and a multi-core cable 40 is pulled into the interior of the grip portion 25 from the lower rear. A wire holding portion 32 made of a rigid material, such as metal, is mounted on the outer periphery of the cable 40 and is accommodated in the grip 25 to hold the cable 40 in the grip 25. Thus, the cable 40 extends in forward and backward directions and is pulled out backward from the grip 25.

The multi-core cable 40 is formed by bundling together four wires 41, such as power wires and signal wires, extending from an unillustrated external power supply and covering the bundled wires with an outer sheath 42 made e.g. of synthetic resin. The outer sheath 42 is stripped off an end of the multi-core cable 40 to expose the loose wires 41, as shown in FIGS. 2 and 3, and the wires 41 are connected to specified connecting portions, such as the male terminals 22 of the front housing 20 (not shown).

Figure 3:
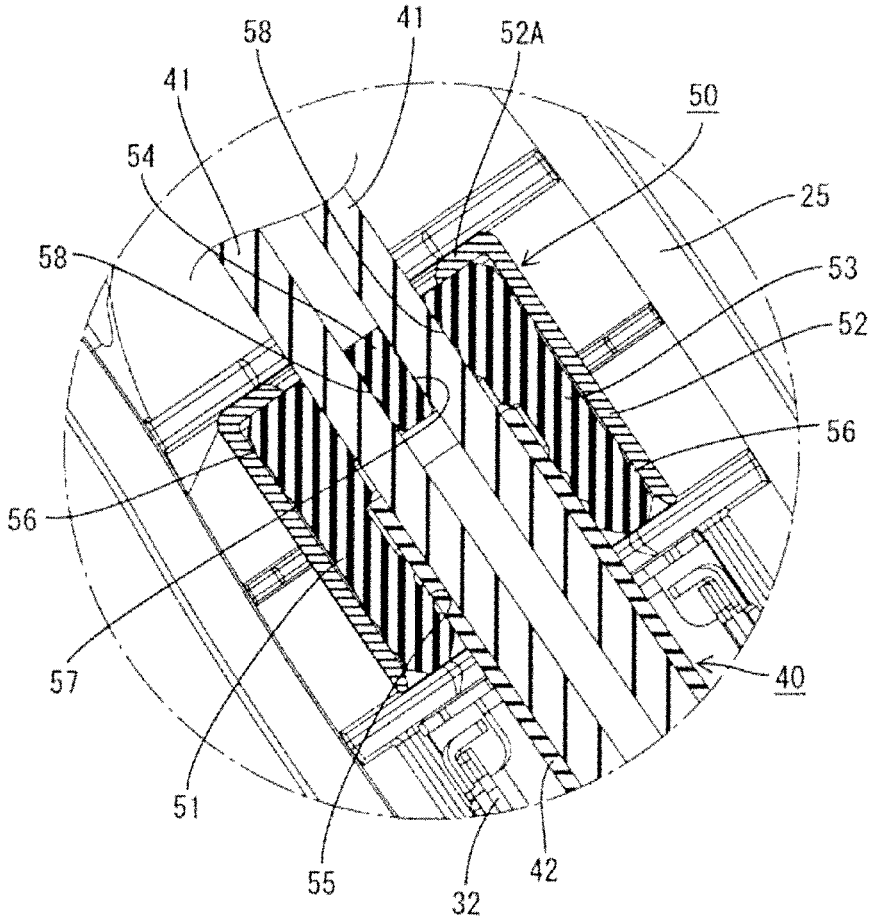
FIG. 3 is an enlarged section of an essential part of FIG. 2.
Figure 4:
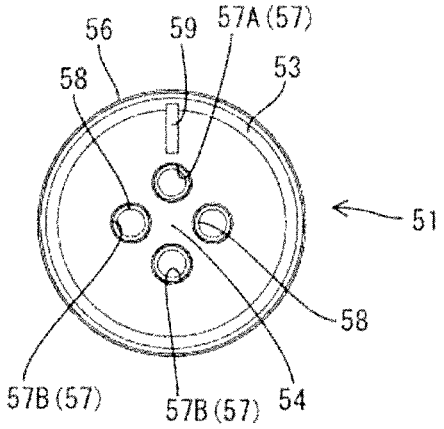
FIG. 4 is a front view of a rubber plug.
Figure 5:
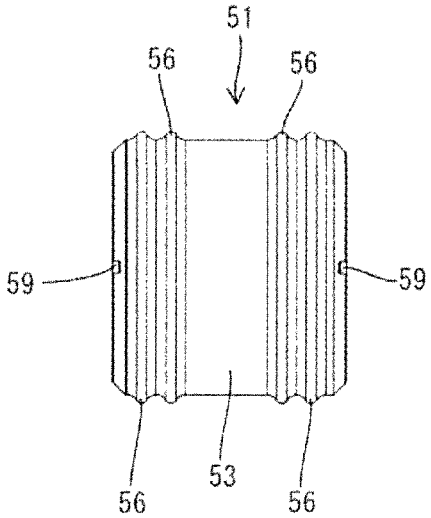
FIG. 5 is a plan view of the rubber plug.
Figure 6:
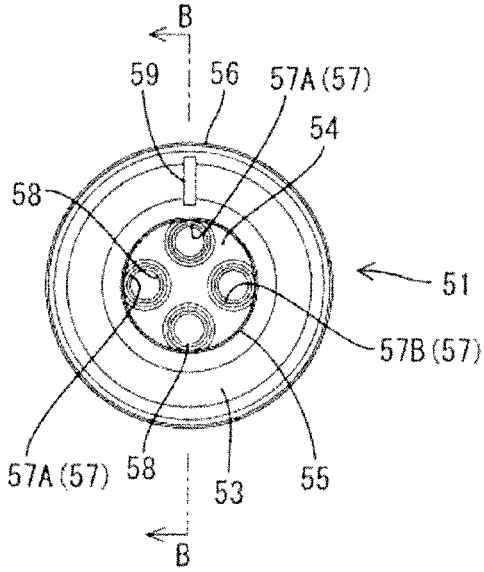
FIG. 6 is a rear view of the rubber plug.
Figure 7:
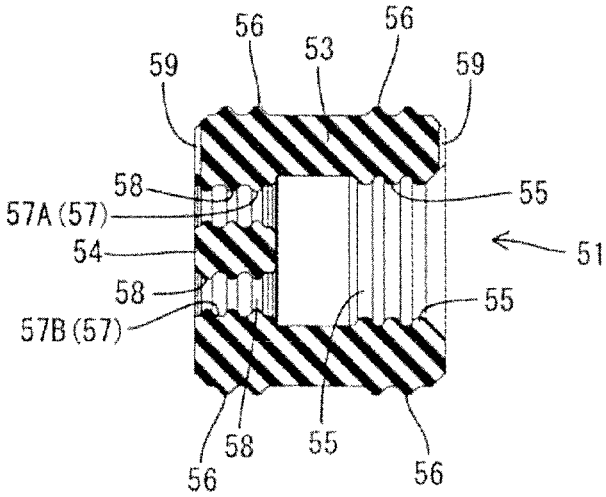
FIG. 7 is a section along B-B of FIG. 6.
Figure 8:
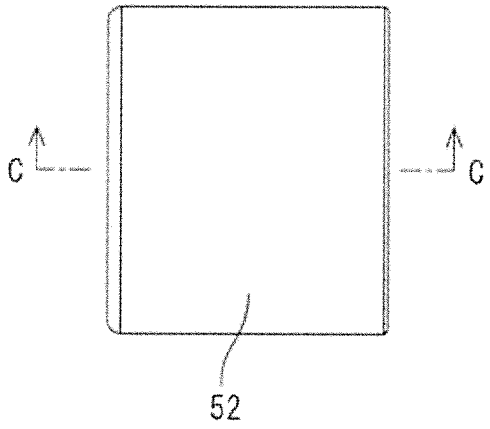
FIG. 8 is a plan view of a cap.
Figure 9:
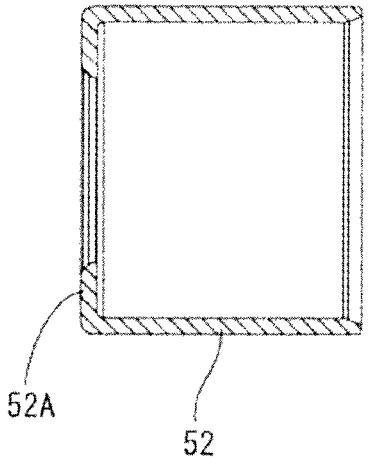
FIG. 9 is a section along C-C of FIG. 8.

A seal member 50 is mounted on an end of the outer sheath 42 of the cable 40, as shown in FIGS. 2 and 3. The seal member 50 comprises a rubber plug 51 to be mounted on the end of the outer sheath 42 of the cable 40 and a cap (or restricting member) 52 made e.g. of synthetic resin that receives the rubber plug 51 inside.

The rubber plug 51 is made of a resilient material (such as natural or synthetic rubber) and, as shown in FIGS. 4 to 7, includes a substantially cylindrical cable seal portion 53 extending in forward and backward directions and a wire seal portion 54 at a front part of the cable seal portion 53.

The cable seal portion 53 is formed so that the outer sheath 42 of the cable 40 can fit into the cable seal portion 53. Outer sheath side lips 55 are formed circumferentially around the inner peripheral surface of the cable seal portion 53 at a rear part of the cable seal portion 53. The outer sheath side lips 55 are held resiliently in close contact with the outer peripheral surface of the outer sheath 42 around the entire circumference when the outer sheath 42 of the cable 40 is fit in the cable seal portion 53. Thus, fluid cannot enter into the cable seal portion 53 through a clearance between the outer sheath 42 and the inner peripheral surface of the cable seal portion 53.

Cap side lips 56 extend circumferentially around the outer periphery of the cable seal portion 53. Two cap side lips 56 are arranged at each of front and rear parts of the cable seal portion 53. The cap side lips 56 on the rear part of the cable seal portion 53 are at the outer side of the outer sheath side lips 55.

As shown in FIG. 3, the wire seal portion 54 is arranged substantially perpendicular to forward and backward directions in which the wires 41 extend, and is formed unitarily to the cable seal portion 53 to close a front end opening of the cable seal portion 53. Further, the wire seal portion 54 is arranged at the inner side of the cap side lips 56 on the front part of the cable seal portion 53.

The wire seal portion 54 has wire insertion holes 57 into which the respective wires 41 exposed from the outer sheath 42 are inserted individually. Four wire insertion holes 57 are formed in this embodiment in conformity with the number of the wires 41 exposed from the outer sheath 42 of the multi-core cable 40.

Each wire insertion hole 57 penetrates through the wire seal portion 54 in forward and backward directions, and wire side lips 58 are provided over the entire circumference of the inner peripheral surface of each wire insertion hole 57 to be held resiliently in close contact with the outer peripheral surface of the wire 41. The wire side lips 58 prevent fluid or water from entering into the cable seal portion 53 through a clearance between the wire 41 and the wire seal portion 54.

The entire end of the outer sheath 42 of the multi-core cable 40 can be covered by the cable seal portion 53 and the wire seal portion 54 with the outer-sheath side lips 55 of the cable seal portion 53 held resiliently in close contact with the outer peripheral surface of the outer sheath 42 and the wire side lips 58 of the wire seal portion 54 held resiliently in close contact with the outer peripheral surfaces of the wires 41. Thus, the end of the outer sheath 42 of the multi-core cable 40 can be made waterproof.

One wire insertion hole 57A has a slightly smaller diameter than the other wire insertion holes 57B and mark 59 extend straight toward a radially outer side at a position radially outwardly of the wire insertion hole 57A having the smaller diameter. The marks 59 are formed as recesses at two positions on the front and rear end surfaces of the cable seal portion 53.

On the other hand, one of the four wires 41 has a slightly smaller outer diameter than the other three wires 41 and the wire 41 having the smaller outer diameter is positioned and fit into the wire insertion hole 57A having the smaller diameter. Thus, the marks 59 enable the wire insertion hole 57A with the smaller diameter to be identified, and the wire 41 having the smaller outer diameter can be inserted easily into the wire insertion hole 57A having the smaller diameter. This can improve operational efficiency when inserting the wires 41 into the wire insertion holes 57 and avoids erroneous insertion of the wire 41 having the smaller outer diameter into the wire insertion hole 57B into which the larger wire 41 should be inserted.

The cap 52 defines a hollow cylinder extending in forward and backward directions. Further, the cable seal portion 53 of the rubber plug 51 substantially conforms to the shape of the cap 52 and is accommodated therein. A front stop 52A is circumferentially provided on the front end edge of the cap 52 and projects in toward an axial center of the cap 52. The cable seal portion 53 is inserted into the cap 52 from behind until the front end surface of the cable seal portion 53 contacts the front stop 52A of the cap 52 to position the cable seal portion 53 at its front end position in the cap 52. Thus the rubber plug 51 is mounted easily at a proper position in the cap 52.

The cable seal portion 53 is accommodated completely in the cap 52 when the rubber plug 51 is mounted at the proper position in the cap 52 and the cap side lips 56 of the cable seal portion 53 closely contact the inner peripheral surface of the cap 52. The cable 40 is assembled with the cable seal portion 53 so that the wires 41 are inserted into the wire insertion holes 57. The cap 52 restricts expansion of front parts of the wire seal portion 54 and the cable seal portion 53, as shown in FIG. 3.

The cap 52 also restricts expansion of the rear part of the cable seal portion 53 that otherwise could be caused be the accommodation of the outer sheath 42 in the rear part of the cable seal portion 53. Thus, fluid or water cannot enter into the cable seal portion 53 through the clearances between the wires 41 and the wire seal portion 54 and/or through the clearance between the outer sheath 42 and the cable seal portion 53.

This embodiment is configured as described above. The procedure of mounting the seal member 50 on the multi-core cable 40 in the charging connector 10 starts by striping the outer sheath 42 from the end of the multi-core cable 40 to make the wires 41 loose.

Subsequently, the resilient plug 51 is inserted into the cap 52 and the wires 41 are inserted into the cable seal portion 53 in the rubber plug 51 from behind so that each wire 41 is inserted into the corresponding wire insertion hole 57. At this time, the wire insertion hole 57A with the smaller diameter is identified by the marks 59 formed near the small wire insertion hole 57A. Hence, each wire 41 can be inserted into the corresponding wire insertion hole 57 without confirming the size of the hole diameter of each wire insertion hole 57, thereby improving operational efficiency when inserting the wires 41.

The wire side lips 58 of the wire seal portion 54 resiliently come into close contact with the outer peripheral surfaces of the wires 41 over the entire circumference when the wires 41 are inserted into the wire insertion holes 57. Similarly, the cable seal lips 56 on the front part of the cable seal portion 53 resiliently come into close contact with the inner peripheral surface of the cap 52 over the entire circumference. Thus, clearances between the wire seal portion 54 and the wires 41 are sealed reliably.

The end of the outer sheath 42 of the cable 40 is inserted into the cable seal portion 53 from behind after the wires 41 are inserted into the respective wire insertion holes 57. As a result, the outer sheath side lips 55 of the cable seal portion 53 resiliently contact the outer peripheral surface of the outer sheath 42 over the entire circumference and the cable seal lips 56 on the rear part of the cable seal portion 53 resiliently contact the inner peripheral surface of the cap 52 over the entire circumference. Thus, clearances between the cable seal portion 53 and the outer sheath 42 are sealed reliably.

The wire seal portion 54 closes clearances adjacent the respective wires 41 and, simultaneously, the clearance between the outer sheath 42 and the cable seal portion 53 can be sealed merely by mounting the rubber plug 51 into the cap 52, inserting the respective wires 41 into the wire insertion holes 57 and inserting the outer sheath 42 into the cable seal portion 53. Thus, the end of the outer sheath 42 of the multi-core cable 40 is made fluid- or waterproof.

As described above, the end of the outer sheath 42 of the multi-core cable 40 can be made waterproof by the inexpensive seal member 50 including the rubber plug 51 and the synthetic resin cap 52. This can reduce production cost as compared with expensive seal members that use a heat shrinkable tube and a sealant.

Further, the end of the outer sheath 42 can be fluid- or waterproofed merely by inserting the rubber plug 51 into the cap 52, inserting the respective wires 41 into the wire insertion holes 57 and inserting the outer sheath 42 into the cable seal portion 53. Thus, the seal member 50 can be mounted very easily on the multi-core cable 40. This can improve efficiency of a fluid- or waterproof operation as compared with the case where a heating treatment is applied after a sealant is filled between the wires 41 at the end of the outer sheath 42 and a heat shrinkable tube is mounted on the end of the outer sheath 42.

Further, sealing is provided by resiliently bringing the rubber plug 41 into close contact with the outer sheath 42 and the wires 41. Hence, a close contact part of the seal member 50 with the outer sheath 42 and the wires 41 can be made smaller as compared with the case where the respective wires are bonded over a long distance in forward and backward directions by filling a sealant between or adjacent to the wires 41 and the outer surface of the outer sheath 42 is sealed by a heat shrinkable tube. This can make a fluid- or waterproof structure smaller and can make the charging connector 10 smaller.

The invention is not limited to the above described embodiment. For example, the following embodiments also are included in the scope of the invention.

One wire insertion hole 57A of the four wire insertion holes 57 has a smaller diameter than the other three. However, all four wire insertion holes may have the same diameter or two wire insertion holes may have a smaller hole diameter.

The marks 59 extend straight in the above embodiment. However, the marks may have a substantially circular shape or an arrow shape.

The cap 52 is made of synthetic resin in the above embodiment. However, a metal cap or a cap of composite material may be used.

The wire seal portion 54 is formed with four wire insertion holes 57 in the above embodiment. However, the wire seal portion may be formed with one, two, three, five or six or more wire insertion holes.

What is claimed is:

1. A seal member to be mounted on an end of a cable that has wires covered with an outer sheath, the seal member being accommodated in a housing of a charging connector and comprising:

a resilient plug made of a resilient material and formed with a cable seal portion that resiliently closely contacts the outer peripheral surface of the outer sheath over an entire circumference of the cable seal portion, and a wire seal portion individually and resiliently closely contacting the outer peripheral surfaces of each of the wires over an entire circumference thereof; and a restricting member externally mounted on the resilient plug and restricting expansion of the resilient plug.

2. The seal member of claim 1, wherein the wire seal portion is provided unitarily to a front end part of the cable seal portion where wires are pulled out.

3. The seal member of claim 2, wherein the cable seal portion is substantially cylindrical and covers an end of the outer sheath over the entire circumference.

4. The seal member of claim 1, wherein the wire seal portion is substantially perpendicular to an extending direction of the wires and closes a front end opening of the cable seal portion.

5. The seal member of claim 1, wherein the restricting member is substantially a cylinder that covers the entire outer peripheral surface of the cable seal portion.

6. The seal member of claim 1, wherein the wire seal portion has a plurality of wire insertion holes for receiving the plurality of wires of the cable.

7. The seal member of claim 6, wherein at least one mark is attached to the cable seal portion for indicating at least a specific one of the respective specific wire insertion holes.

8. The seal member of claim 1, wherein one or more outer sheath side lips are provided on an inner peripheral surface of the cable seal portion for resiliently and closely contacting the outer peripheral surface of the outer sheath.

9. The seal member of claim 8, wherein the outer sheath side lips are on a rear area of the cable seal portion, and closely contact the outer peripheral surface of the outer sheath when the outer sheath of the cable is fit into the cable seal portion.

10. The seal member of claim 1, wherein one or more cap side lips are provided on an outer peripheral surface of the cable seal portion.

11. The seal member of claim 10, wherein the wire seal portion is arranged at the inner side of the cap side lips near a front part of the cable seal portion.

12. A charging connector comprising:

a housing, and the seal member of claim 1 mounted on an end of a cable, in which wires are covered with an outer sheath, and the seal member being accommodated into the housing.

* * * * *